US007128601B2

(12) United States Patent
Suemitsu et al.

(10) Patent No.: US 7,128,601 B2
(45) Date of Patent: Oct. 31, 2006

(54) WIRE COVER FOR CONNECTORS

(75) Inventors: Yoshifumi Suemitsu, Chiba (JP); Kazushige Sakamaki, Tokyo (JP); Ryuichi Komiyama, Tokyo (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/335,723

(22) Filed: Jan. 19, 2006

(65) Prior Publication Data

US 2006/0166549 A1 Jul. 27, 2006

(30) Foreign Application Priority Data

Jan. 21, 2005 (JP) ..... 2005-013512

(51) Int. Cl.
*H01R 13/52* (2006.01)

(52) U.S. Cl. ..... 439/521; 439/902

(58) Field of Classification Search ..... 439/901–904, 439/466–468, 470, 473, 519, 521
See application file for complete search history.

(56) References Cited

U.S. PATENT DOCUMENTS 3,936,129 A * 2/1976 Guy ..... 439/464
4,070,548 A * 1/1978 Kasper ..... 439/147
4,195,899 A * 4/1980 Radloff et al. ..... 439/468
4,203,643 A * 5/1980 Krolak et al. ..... 439/468
4,214,803 A * 7/1980 McKee et al. ..... 439/468
4,239,317 A * 12/1980 Hesse et al. ..... 439/43
4,239,320 A * 12/1980 Hesse et al. ..... 439/640
4,408,819 A * 10/1983 Guelden ..... 439/638
4,483,580 A * 11/1984 Pelczarski ..... 439/460
5,007,858 A * 4/1991 Daly et al. ..... 439/498
5,259,785 A * 11/1993 Inaba et al. ..... 439/466
5,271,739 A * 12/1993 Denlinger et al. ..... 439/466
5,282,760 A * 2/1994 Aimasso ..... 439/752
5,295,859 A * 3/1994 Kawai et al. ..... 439/455
5,315,062 A * 5/1994 Hoshino ..... 439/446
5,328,388 A * 7/1994 Fust et al. ..... 439/544
5,480,312 A * 1/1996 Watanabe et al. ..... 439/135
5,489,224 A * 2/1996 Schwarz ..... 439/752
5,564,953 A * 10/1996 Endo et al. ..... 439/701
5,569,040 A * 10/1996 Sumida ..... 439/157
5,586,909 A * 12/1996 Saba ..... 439/559
5,672,078 A * 9/1997 Fukamachi et al. ..... 439/701
5,688,144 A * 11/1997 Kosuge ..... 439/596
5,762,520 A * 6/1998 Martin ..... 439/470
5,897,392 A * 4/1999 Takahashi et al. ..... 439/470

(Continued)

FOREIGN PATENT DOCUMENTS

JP 5(1993)-069868 9/1993

(Continued)

*Primary Examiner*—Ross Gushi
(74) *Attorney, Agent, or Firm*—Barley Snyder LLC

(57) ABSTRACT

A wire cover for an electrical connector that defines the direction in which a plurality of wires is led out of the electrical connector comprises a main body having side walls. At least one of the side walls has an interference member receiving recess. An elastic engaging member extends from a lower edge of at least one of the side walls. The elastic engaging member has an elastic tongue member bent upwards from the lower edge such that a gap is formed between the elastic tongue member and the side wall. An interfering member extends from the elastic engaging member and into the interference member receiving recess when the elastic engaging member is flexed. The interfering member substantially covers the gap. An electrical connector engaging protrusion extends from the elastic engaging member and engages the electrical connector.

17 Claims, 9 Drawing Sheets

U.S. PATENT DOCUMENTS 5,908,327 A * 6/1999 Tsuji et al. ..... 439/470
5,947,762 A * 9/1999 Katsuma ..... 439/468
5,967,830 A * 10/1999 Tsuji ..... 439/470
5,971,797 A * 10/1999 Straub et al. ..... 439/468
6,050,839 A * 4/2000 Seminara et al. ..... 439/364
6,095,852 A * 8/2000 Gregory, II ..... 439/540.1
6,139,355 A * 10/2000 Puerner ..... 439/473
6,155,884 A * 12/2000 Sugiyama ..... 439/701
6,171,136 B1 * 1/2001 Liu et al. ..... 439/466
6,203,362 B1 * 3/2001 Tsuji ..... 439/470
6,350,147 B1 * 2/2002 Brownell et al. ..... 439/468
6,361,336 B1 * 3/2002 Zhao et al. ..... 439/157
6,419,522 B1 * 7/2002 Bonilla ..... 439/595
6,540,547 B1 * 4/2003 Zweigle ..... 439/468
6,817,888 B1 * 11/2004 Kozono et al. ..... 439/468
6,824,420 B1 * 11/2004 Ushiro et al. ..... 439/455
6,832,922 B1 * 12/2004 Kozono et al. ..... 439/135
6,899,556 B1 * 5/2005 Nishida et al. ..... 439/188
6,962,504 B1 * 11/2005 Fukui et al. ..... 439/466
7,014,498 B1 * 3/2006 Munoz ..... 439/473
7,021,959 B1 * 4/2006 Tsuji et al. ..... 439/470
2001/0005652 A1 * 6/2001 Brownell et al. ..... 439/466
2002/0055299 A1 * 5/2002 Zweigle ..... 439/468
2003/0109169 A1 * 6/2003 Ushiro et al. ..... 439/468
2003/0199184 A1 * 10/2003 Martin et al. ..... 439/157
2003/0228782 A1 * 12/2003 Nishida et al. ..... 439/188
2004/0102082 A1 * 5/2004 Tsuji et al. ..... 439/470
2005/0003698 A1 * 1/2005 Hata ..... 439/470
2005/0003699 A1 * 1/2005 Fukui et al. ..... 439/473
2006/0009067 A1 * 1/2006 Sakamaki et al. ..... 439/468
2006/0089020 A1 * 4/2006 Kanamaru ..... 439/76.2
2006/0089021 A1 * 4/2006 Kanamaru ..... 439/76.2

FOREIGN PATENT DOCUMENTS

JP 11(1999)-291835 10/1999

* cited by examiner

WIRE COVER FOR CONNECTORS

FIELD OF THE INVENTION

The invention relates to a wire cover for connectors that is mounted on a wire leading section of an electrical connector and defines the directions in which a plurality of wires are led out of the electrical connector.

BACKGROUND OF THE INVENTION

FIG. 1 of Japanese Unexamined Utility Model Publication No. 5(1993)-069868 illustrates an example of a wire cover for connectors. The wire cover is mounted on a rear section of a connector main body and includes two pairs of latch members having engaging apertures therethrough at both sides thereof. The engaging apertures engage with engaging protrusions, which are provided on side surfaces of an electrical connector, to fix the wire cover to the electrical connector.

Because the wire cover is mounted on the rear surface of the electrical connector at a location where a plurality of wires connected to contacts are led out, the wire cover must be mounted while fitting a great number of wires there through. A comparatively large amount of force is therefore required to mount the wire cover onto the electrical connector. In the above-described wire cover, the wire cover is pressed against the electrical connector to flex the latch arms to engage the engaging apertures and the engaging protrusions on both sides substantially simultaneously. Thus, the force required to mount the wire cover onto the electrical connector is high, because not only is a force required to fit the plurality of wires through, but also an additional amount of force is required to engage the latch arms and the engaging protrusions.

FIG. 6 of Japanese Unexamined Patent Publication No. 11(1999)-291835 illustrates another known mechanism for mounting a wire cover. The wire cover is not mounted to an electrical connector, however, but to a flat panel trim within an interior of an automobile. The wire cover seals an opening formed in the trim. A cutout and a locking aperture are formed in opposing edges of the opening in the trim. An engaging member and an elastic U-shaped locking member are formed on the wire cover and engage the cutout and the locking aperture, respectively.

In the above-described wire cover, a great amount of force is not required for engagement of the U-shaped locking member. There are instances, however, where pieces become trapped within the open groove or gap of the U-shaped locking member. The wires therefore may become entangled in the U-shaped locking member, causing excessive force to be applied thereto and damaging the U-shaped locking member. Additionally, when a great number of the wire covers having this structure are packed in a bag or the like, the U-shaped locking members may become entangled with each other and damaged.

SUMMARY OF THE INVENTION

The present invention has been developed in view of the foregoing circumstances. It is therefore an object of the present invention to provide a wire cover for connectors, which can easily be mounted onto an electrical connector while having a structure that reduces damage to the wire cover due to entanglements with other wire covers or wires.

This and other objects are achieved by a wire cover for an electrical connector that defines the direction in which a plurality of wires is led out of the electrical connector comprising a main body having side walls. At least one of the side walls has an interference member receiving recess. An elastic engaging member extends from a lower edge of at least one of the side walls. The elastic engaging member has an elastic tongue member bent upwards from the lower edge such that a gap is formed between the elastic tongue member and the side wall. An interfering member extends from the elastic engaging member and into the interference member receiving recess when the elastic engaging member is flexed. The interfering member substantially covers the gap. An electrical connector engaging protrusion extends from the elastic engaging member and engages the electrical connector.

This and other objects are further achieved by an electrical connector comprising a connector main body having a wire cover mounting recess surrounded by walls. The walls have openings formed in corners thereof. A wire cover is mounted in the wire cover mounting recess. The wire cover has a main body with an elastic engaging member extending from a lower edge thereof that engages one of the openings and an engaging protrusion extending from the lower edge thereof that engages another one of the openings. The engaging protrusion is inelastic and acts as a pivot point for the wire cover when engaged in the opening.

DETAILED DESCRIPTION OF THE INVENTION

Figure 2A:
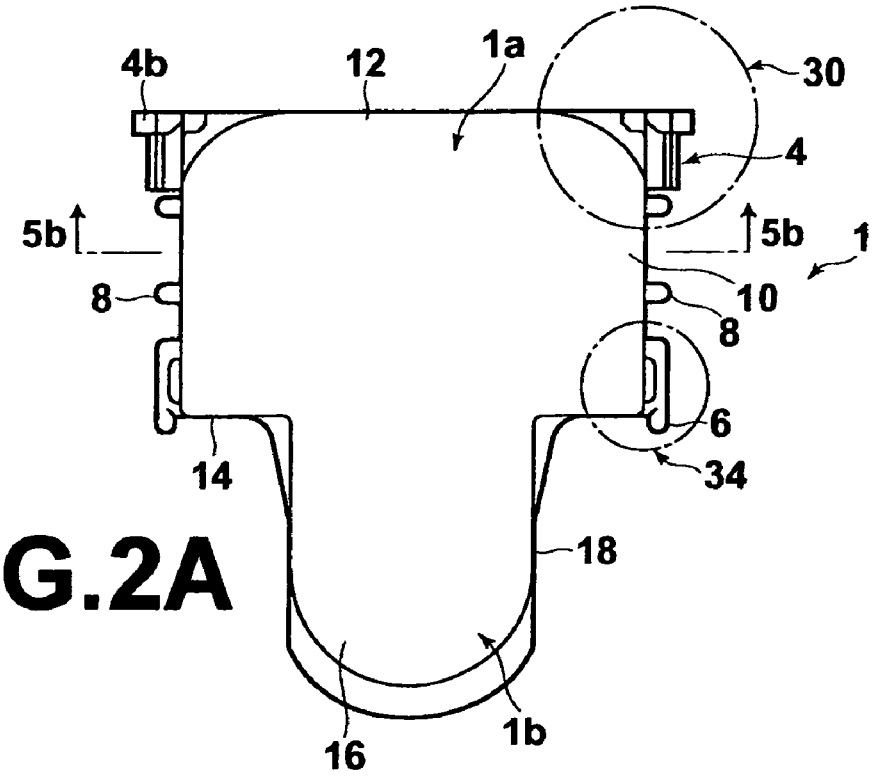
FIG. 2A is a plan view of the wire cover.
Figure 2B:
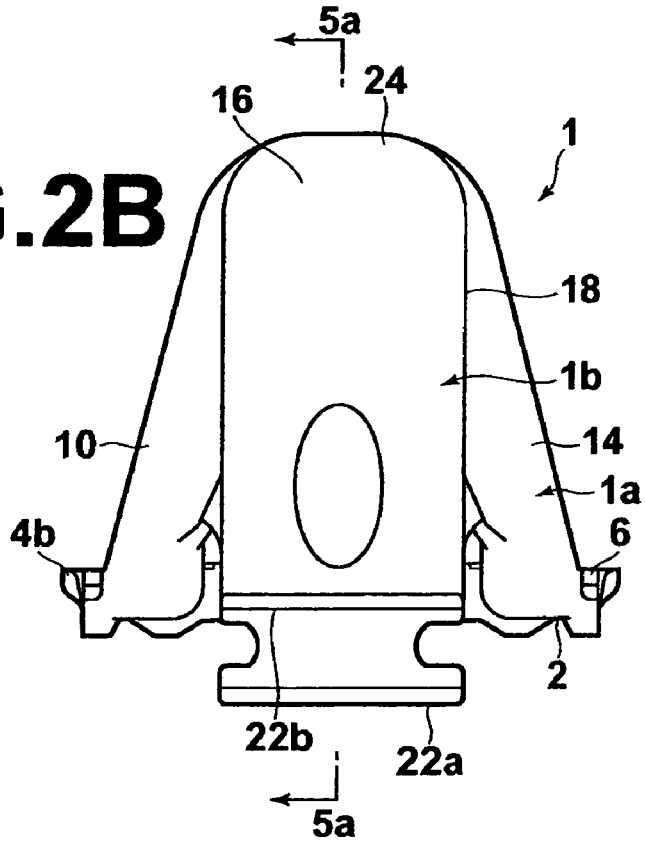
FIG. 2B is a front view of the wire cover.

A wire cover 1 according to an embodiment of the invention will be described in detail with reference to the Figures. In the description herein, reference to the front and rear directions refer to the lower and upper sides of FIG. 2A, respectively. Additionally, reference to the up and down directions refer to the upper and lower sides of FIG. 2B, respectively.

Figure 1:
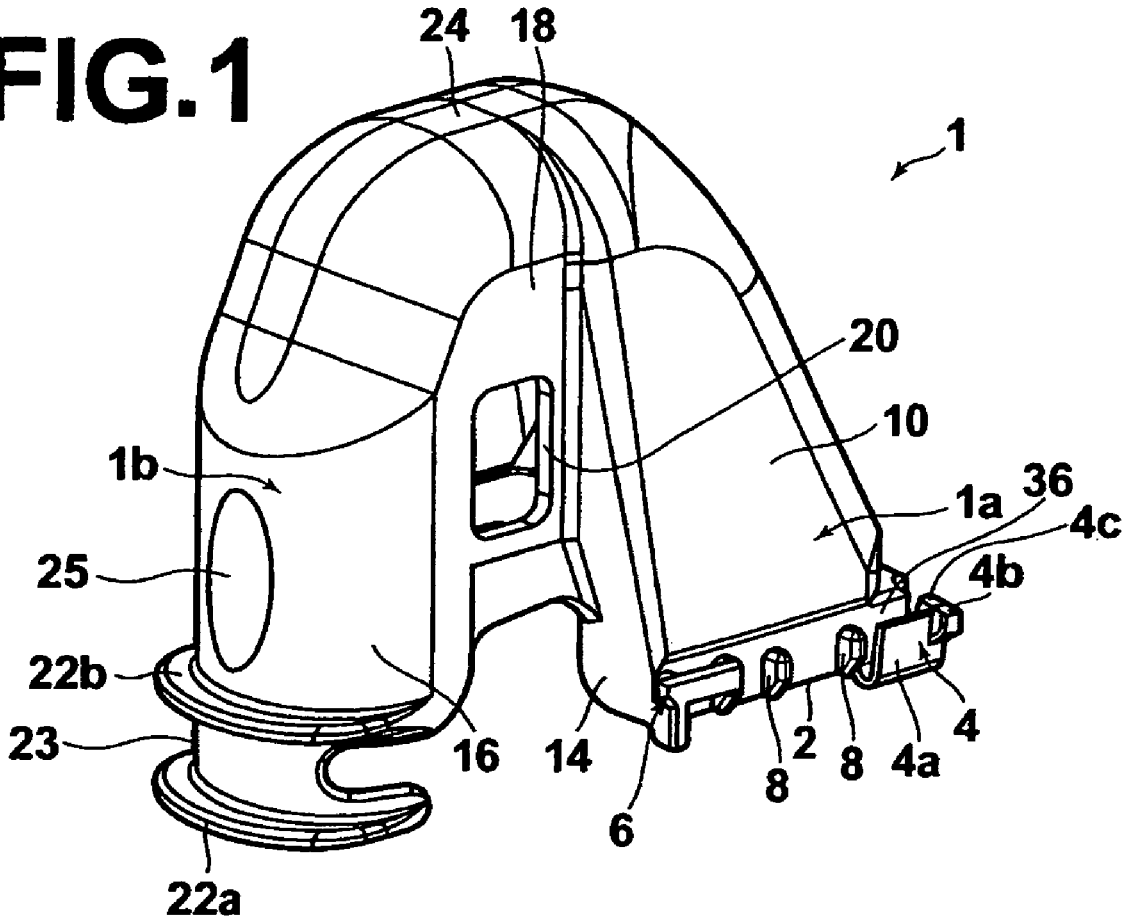
FIG. 1 is a perspective view of a wire cover for connectors according to an embodiment of the invention.
Figure 4A:
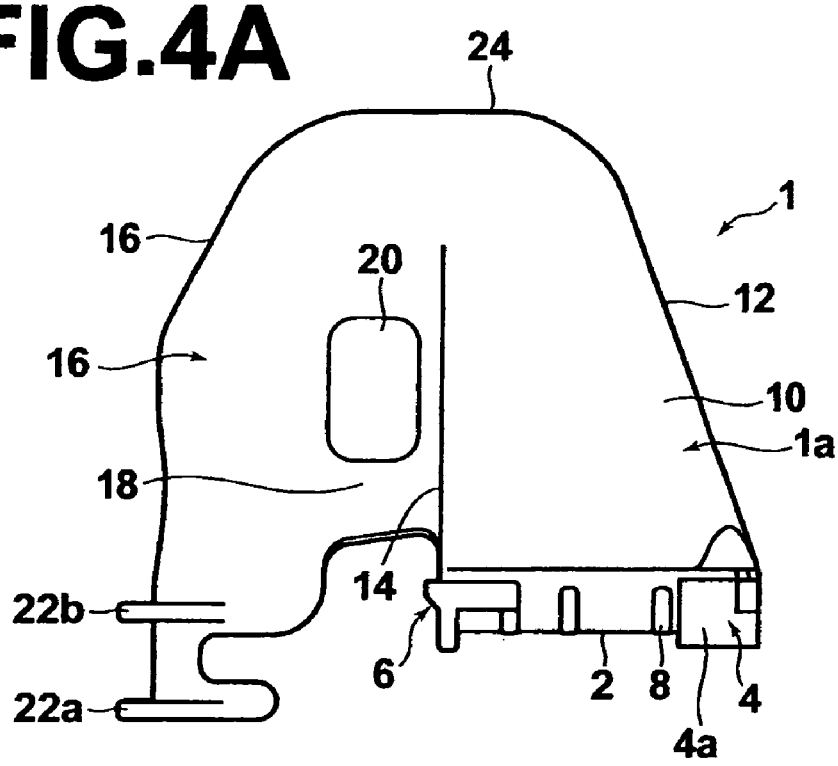
FIG. 4A is a right side view of the wire cover.
Figure 4B:
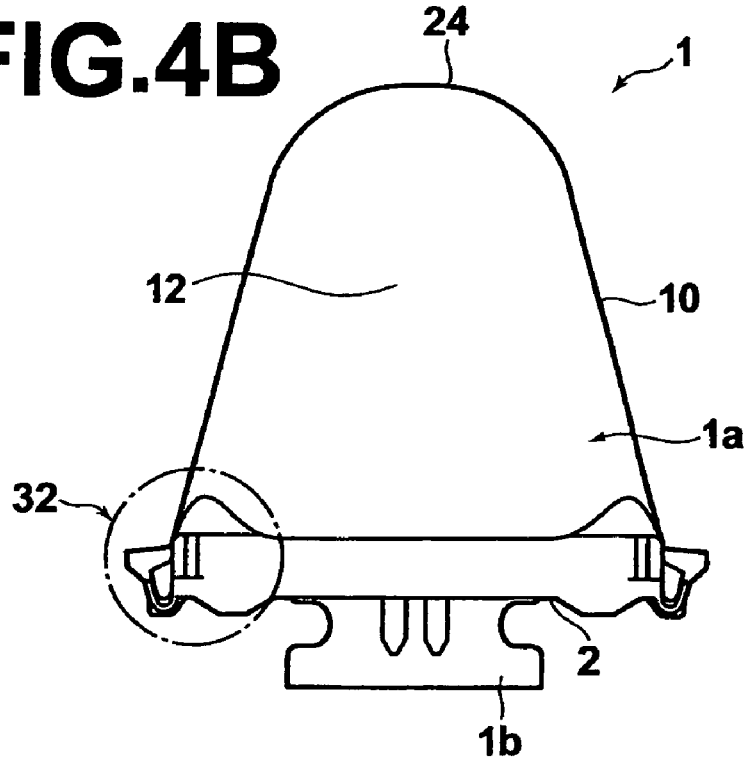
FIG. 4B is a rear view of the wire cover.

As shown in FIG. 1, the wire cover 1 may be integrally formed from a synthetic resin. The wire cover 1 has an outer shell comprising a main body 1*a* and a wire guiding section 1*b*, which may be molded continuously with the main body 1*a*. The wire cover 1 may be formed to be substantially symmetrical in the horizontal direction. A lower edge 2 of the main body 1 is shaped as a substantially rectangular frame. As shown in FIGS. 4A–4B, side walls 10 and a rear wall 12 of the main body 1*a* extend upward from the lower edge 2 such that the side walls 10 and the rear wall 12 converge. Front walls 14 extend slightly inward from each of the side walls 10 and extend upward substantially perpendicular to the lower edge 2. A wire guiding section 1*b* extends forward continuously from the front walls 14 and the rear wall 12. The wire guiding section 1*b* extends downward in an arcuate manner from the rear wall 12 via a peak 24. Side surfaces 18 of the wire guiding section 1*b* are formed continuously with an arcuate surface 16 that extends from the upper portion to the front portion of the wire guiding section 1*b*. The side surfaces 18 extend from the arcuate surface 16 to the front walls 14. Wire viewing openings 20 are formed in each of the side surfaces 18, as shown in FIG. 4A. As shown in FIG. 1, a finger receiving recess 25 is provided in the front surface of the wire guiding section 1*b*. Vertically separated flanges 22*a*, 22*b* are formed at the leading end of the wire guiding section 1*b*. The flanges 22*a*, 22*b* are curved along the arcuate surface 16 within the horizontal plane. A groove 23 is formed between the flanges 22*a*, 22*b*.

Figure 3:
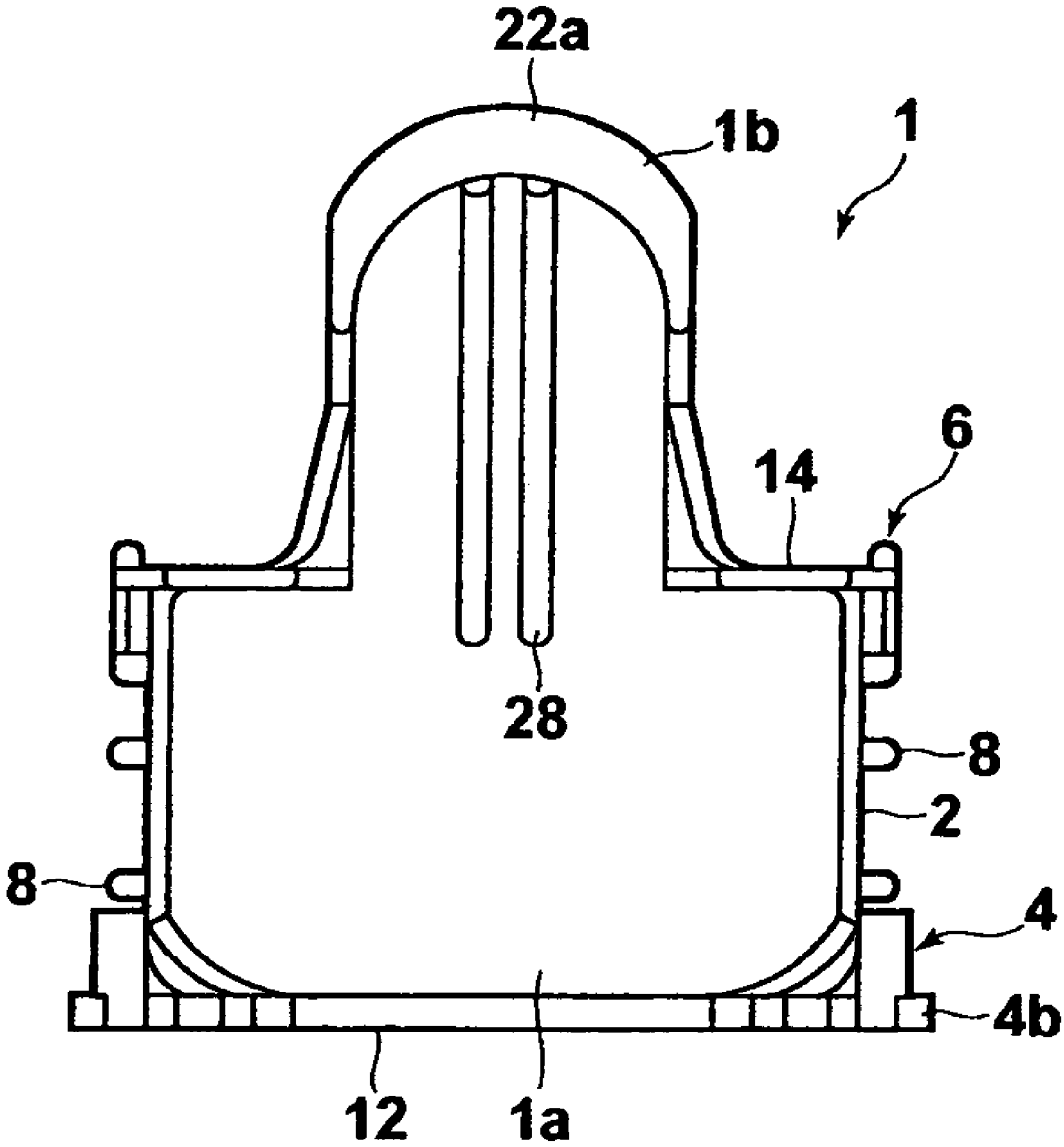
FIG. 3 is a bottom view of the wire cover.
Figure 5A:
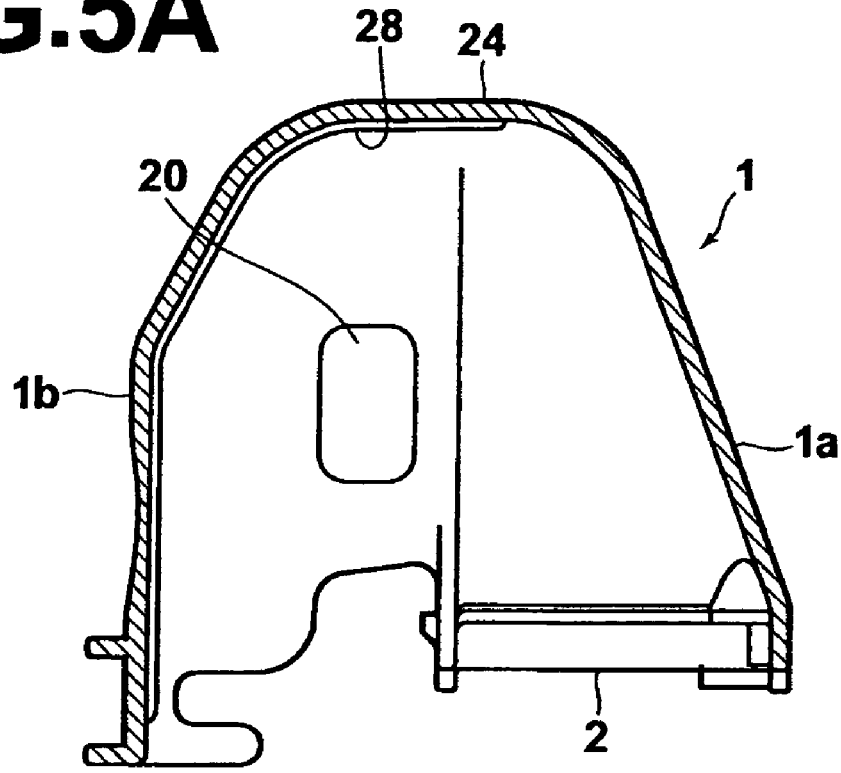
FIG. 5A is a sectional view taken along line 5A—5A of FIG. 2B.
Figure 5B:
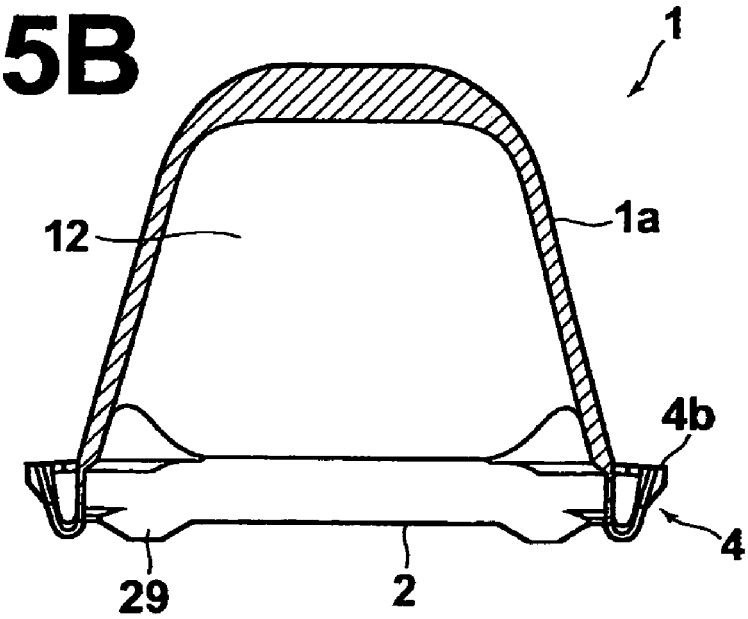
FIG. 5B is a sectional view taken along line 5B—5B of FIG. 2A.

As shown in FIGS. 5A–5B, the wire cover 1 may be molded to be of a substantially uniform thickness. Unidirectionally parallel beads 28 that prevent deformation of the wire cover 1 are formed on an interior surface of the wire cover 1 such that they extend from the peak 28 of the wire cover 1 to the leading end of the wire guiding section 1*b*, as shown in FIGS. 3 and 5A. The beads 28 prevent deformation of the wire cover 1 due to the amount of strain exerted on the wire cover 1 by the densely packed and guided wires 60 therein. The beads 28 extend along the direction in which the wires 60 are guided. Arcuate protrusions 29 are formed at both ends of the lower edge 2 of the rear wall 12, as shown in FIG. 5B.

Figure 6A:
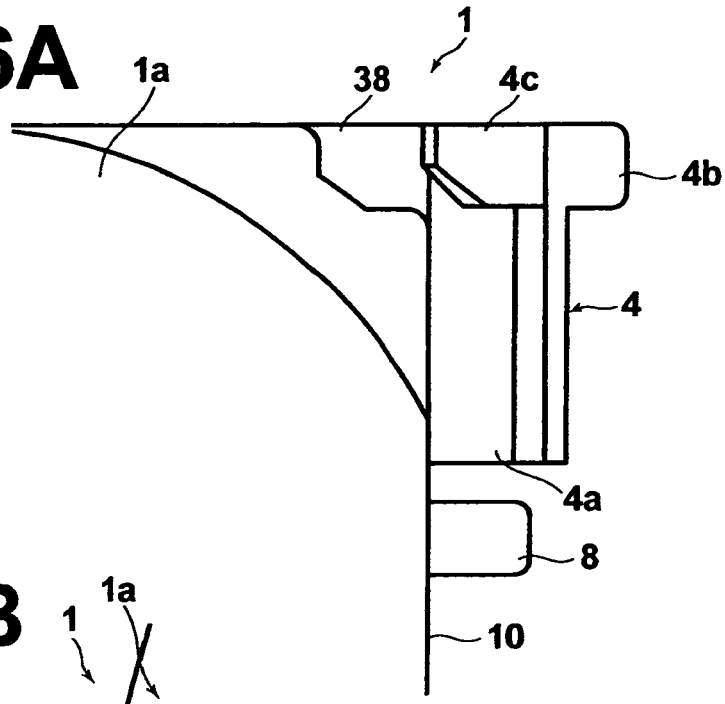
FIG. 6A is a partial magnified view of region 30 in FIG. 2A that shows an elastic engaging member.
Figure 6B:
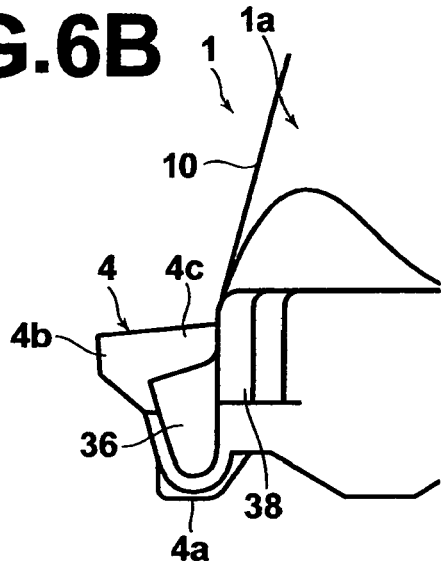
FIG. 6B is a partial magnified view of region 32 in FIG. 4B that shows an elastic engaging member.
Figure 7:
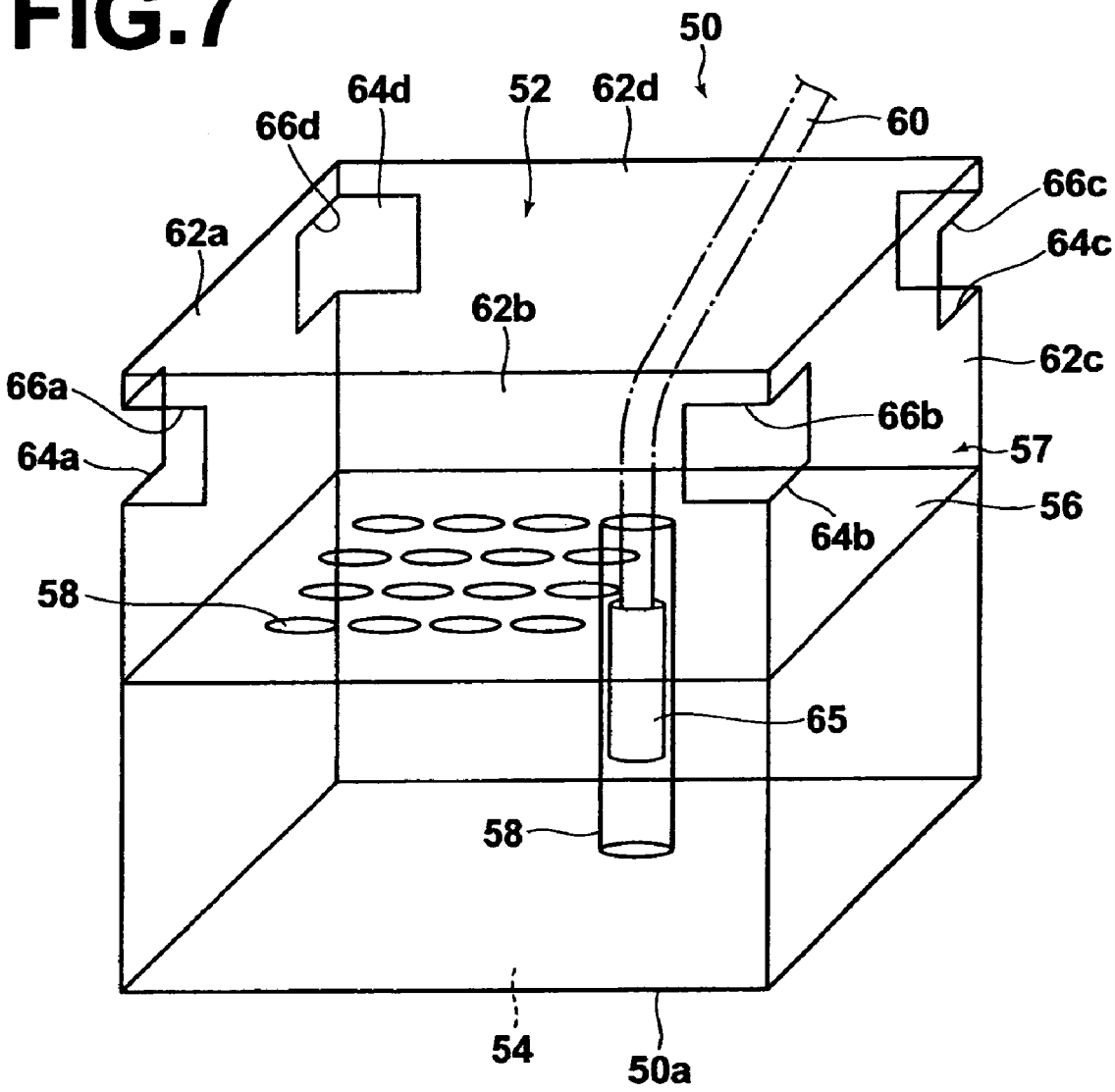
FIG. 7 is a transparent schematic view of an electrical connector to which the wire cover is mounted.

As shown in FIG. 1, elastic engaging members 4 are provided at both corners on sides of the lower edge 2 and away from the wire guiding section 1*b*. As shown in FIGS. 6A–6B, each of the elastic engaging members 4 comprises an elastic tongue member 4*a* and an electrical connector engaging protrusion 4*b*. The elastic tongue member 4*a* is bent back upwards from the lower edge 2 of the side wall 10 in an arcuate manner, as shown in FIG. 1. The electrical connector engaging protrusion 4*b* is provided at the rear end of the tip or free end of the elastic tongue member 4*a*. The electrical connector engaging protrusion 4*b* protrudes outward from the side wall 10 in a direction away from an exterior of the wire cover 1 and is formed to engage an electrical connector 50 (FIG. 7). A rod-shaped interfering member 4*c* is provided at about the same position as the electrical connector engaging protrusion 4*b* and extends toward the side wall 10 in the opposite direction from the electrical connector engaging protrusion 4*b*. The interfering member 4*c* is of a length sufficient to substantially cover a gap 36 formed between the elastic tongue member 4 and the side wall 10, as shown in FIGS. 6A–6B. An interfering member receiving recess 38 that corresponds to the interfering member 4*c* is formed in a rear corner of the wire cover 1. The interfering member receiving recess 38 is provided as an escape for the interfering member 4*c* such that the interfering member 4*c* does not strike the side wall 10 or the rear wall 12 when the elastic engaging member 4 is flexed. The interfering member 4*c* reduces the likelihood that other members or the wires 60 will become entangled with the free end of the elastic engaging member 4. Accordingly, the likelihood of damage to the elastic engaging member 4 due to excessive force being applied thereto is also reduced. Although the elastic engaging members 4 curve upward along the main body 1*a* from the lower edge 2 thereof and are shaped as substantial U-shaped members in the illustrated embodiment, it will be appreciated by those skilled in the art that the elastic engaging members 4 may also be formed as substantially V-shaped members that extend upward without a curve.

Figure 6C:
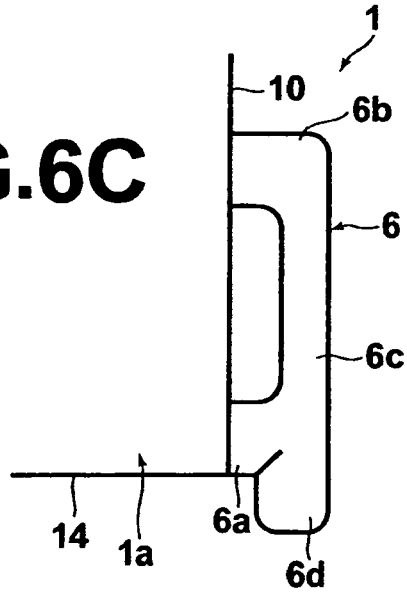
FIG. 6C is a partial magnified view of region 34 in FIG. 2A that shows an engaging protrusion.

As shown in FIG. 1, engaging protrusions 6 are provided at both corners on the sides of the lower edge 2 toward the wire guiding section 1*b*. As shown in FIG. 6C, the engaging protrusion 6 comprises vertically extending ribs 6*a*, 6*b* that are separated in the front to back direction. The ribs 6*a*, 6*b* are joined by a linking member 6*c* at upper ends thereof in the front to back direction. The linking member 6*c* comprises an electrical connector engaging extension 6*d* that extends forward beyond the front wall 14. The engaging protrusion 6 is substantially rigid and inelastic. The engaging protrusion 6 therefore engages securely with the electrical connector 50 (FIG. 7). Although the protruding direction of the engaging protrusions 6 and the protruding direction of the electrical connector engaging electrical connector engaging protrusions 4*b* of the elastic engaging members 4 are illustrated as being perpendicular to each other in the illustrated embodiment, it will be appreciated by those skilled in the art that the relationship between the protruding directions is not limited to such a configuration, and the engaging protrusions 6 and the electrical connector engaging electrical connector engaging protrusions 4*b* may protrude in the same direction. Support ribs 8 are provided between the elastic engaging member 4 and the engaging protrusion 6 in a vicinity of a lower edge of each of the side walls 10 of the main body 1*a*.

FIG. 7 shows the electrical connector 50. The electrical connector 50 is substantially cuboid in shape and comprises a connector main body 50*a* with a wire cover mounting recess 52 formed in the rear portion of the electrical connector 50. Contact housing channels 58 are formed from an engaging surface 54 to a rear surface 56. The wires 60 are guided out from the contact housing channels 58 at the rear surface 56, as illustrated by the broken line in FIG. 7. The wire cover mounting recess 52 is surrounded by walls 62*a*, 62*b*, 62*c*, 62*d*. Openings 64*a*, 64*b*, 64*c*, 64*d* are formed at corners of the walls 62*a*, 52*b*, 52*c*, 62*d*. The openings 64*a*, 64*b*, 64*c*, 64*d* straddle pairs of adjacent walls 62*a*, 52*b*, 52*c*, 62*d*. The rear surface 56 and the walls 62*a*, 62*b*, 62*c*, 62*d* through which the wires 60 are led out of the electrical connector 50 will be collectively referred to herein as a wire leading section 57. The other structures of the electrical connector 50 are not directly relevant to the present invention, and detailed descriptions thereof will therefore be omitted.

Figure 8:
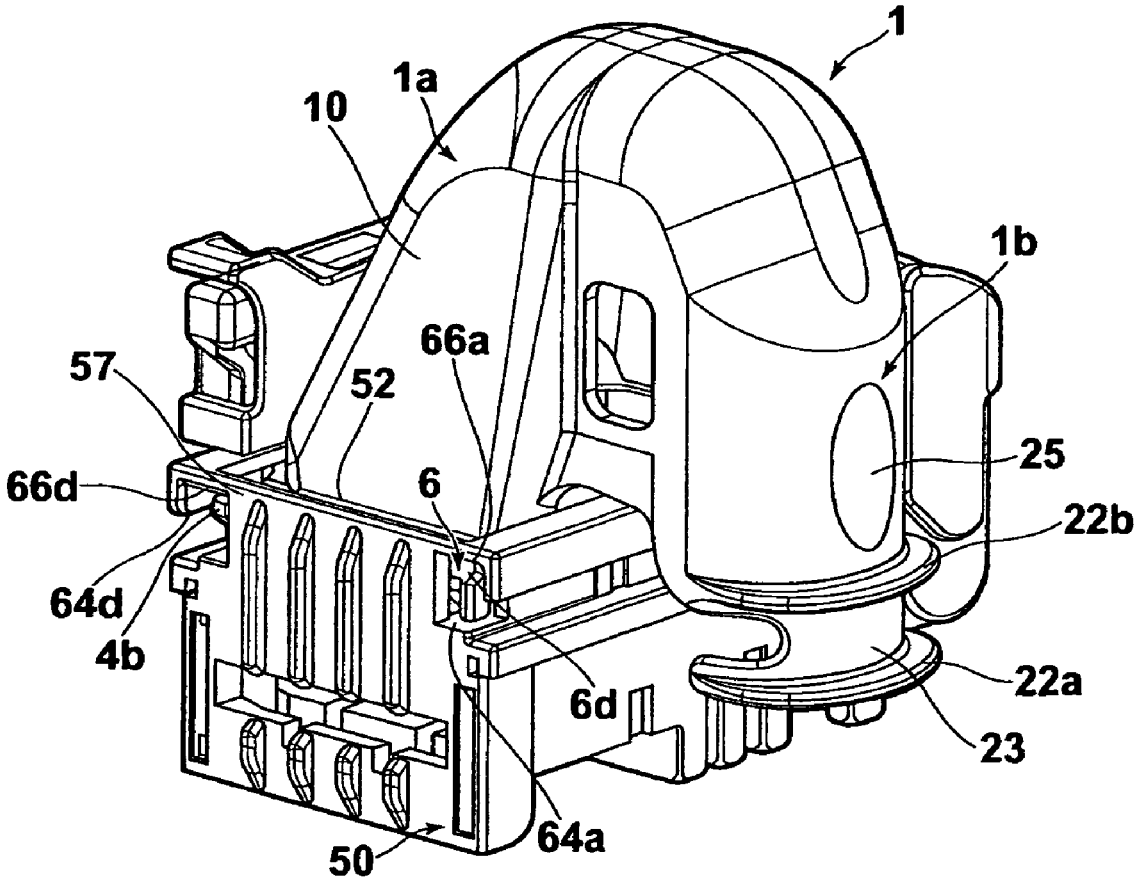
FIG. 8 is a perspective view of the wire cover mounted on the electrical connector.

The method of mounting the wire cover 1 to the electrical connector 50 will now be described. As shown in FIGS. 8–9B, when mounting the wire cover 1 onto the electrical connector 50, each of engaging protrusions 6 are engaged with the upper edges 66*a*, 66*b* of the openings 64*a*, 64*b*, respectively. The wire cover 1 is then rotated downward such that the engaged portions of the engaging protrusions 6 and the openings 64*a*, 64*b* act as pivot points. The elastic engaging members 4 are pressed into the openings 64*d*, 64C, thereby causing the elastic engaging members 4 to flex inward. The protrusions 4*d* are enabled to pass the upper edges 66*d*, 66*c* of the openings 64*d*, 64*c* by the inward flexing. After the protrusions 4*d* pass the upper edges 66*d*, 66*c*, the elastic engaging members 4 elastically return to their original positions, and the protrusions 4*d* engage the upper edges 66*d*, 66*c* of the openings 64*d*, 64*c*, respectively, thereby preventing upward removal of the wire cover 1. The bottom edge 2 of the main body 1*a* of the wire cover 1 is housed within the wire cover mounting recess 52 along the walls 62*a*, 62*b*, 62*c*, 62*d*.

Figure 9A:
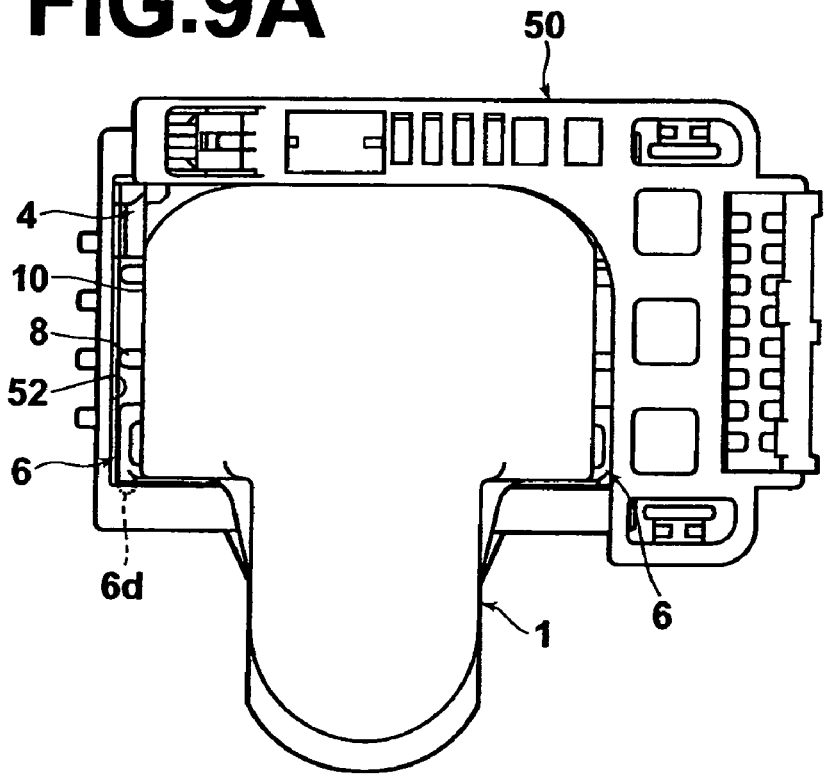
FIG. 9A is a plan view of the wire cover mounted on the electrical connector.
Figure 9B:
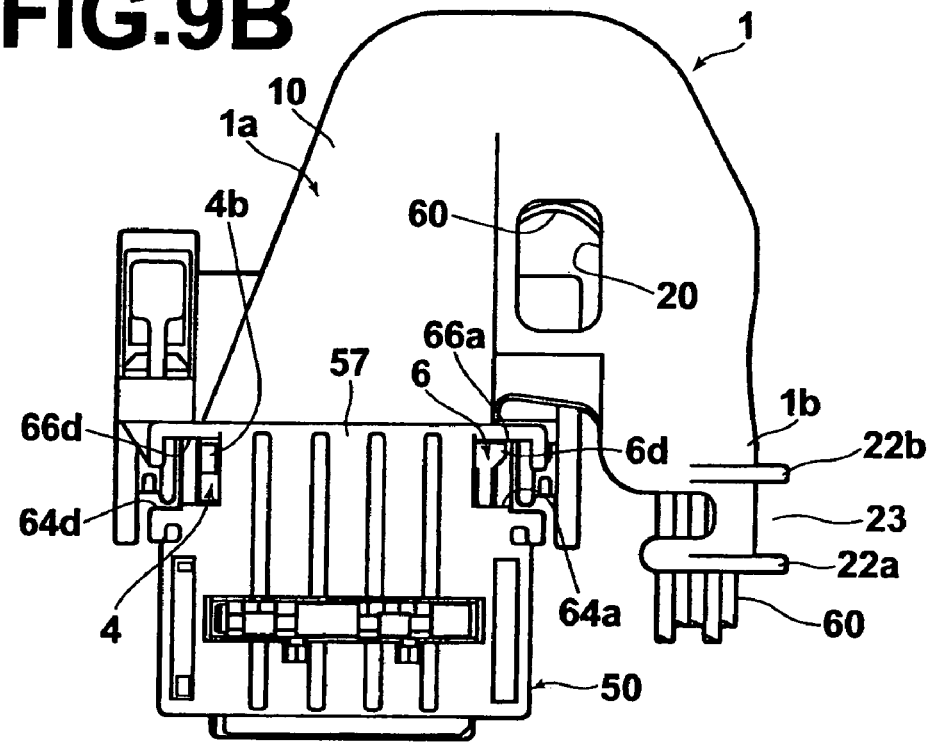
FIG. 9B is a side view of the wire cover mounted on the electrical connector.

As most clearly illustrated in FIG. 9A, the support ribs 8 are positioned between the wire cover 1 and the interior surface of the wire cover mounting recess 52 of the electrical connector 50 to prevent positional shifting between the wire cover 1 and the electrical connector 50. The arcuate protrusions 29 are positioned between the rear surface 56 of the electrical connector 50 and the wire cover 1 and also prevent positional shifting there between. The wires 60 are guided such that they are directed downward from the tip of the wire guiding section 1*b*, as shown in FIG. 9B. The groove 23 between the two flanges 22*a*, 22*b* is configured to receive a linear binding member (not shown) for holding the wires 60 within the wire guiding section 1*b* therein. At this time, an operator visually confirms that the wires 60 within the wire cover 1 are arranged appropriately through the wire viewing openings 20 and then binds the wires 60. For example, if the wires 60 are visible through the entirety of the wire viewing openings 20, it can be understood that the wires 60 are not properly arranged along the interior surface of the wire cover 1. In this case, the operator presses the wires 60 into the wire cover 1 to correct the arrangement thereof before binding the wires 60.

Because the engaged portion of the wire cover 1 acts as a pivot point, the wire cover 1 can be easily mounted onto the electrical connector 50 with little force. Additionally, if an external force is applied to the wires 60, which are guided out of the wire guiding section 1*b*, the wire cover 1 is prevented from being removed from the electrical connector 50 due to the solid engagement between the engaging protrusion 6 and the openings 64*a*, 64*b*. The wire cover 1 is therefore easily mounted on the electrical connector and inadvertent removal by force being applied to the wire cover 1, due, for example, from the wires 60 being pulled, is prevented. As a result, the engagement between the wire cover 1 and the electrical connector 50 is positively maintained. Further, the interfering member 4*c* prevents wires and the like from entering the gap 36 of the elastic engaging member 4. Accordingly, the risk of damage to the elastic engaging member 4, due to other wire covers or wires becoming entangled therein can be reduced.

When removing the wire cover 1 from the connector 50, the engagement between the elastic engaging members 4 and the openings 64*d*, 64*c* is released by flexing the elastic engaging members 4 inward. The wire cover 1 is then rotated upwards with the engaged portions of the engaging protrusions 6 and the openings 64*a*, 64*b* acting as pivot points. The engagement between the engaging protrusions 6 and the openings 64*a*, 64*b* is disengaged. Because the engaged portion of the wire cover 1 acts as a pivot point, the wire cover 1 can be easily removed from the electrical connector 50 with little force.

A preferred embodiment of the present invention has been described above. The invention, however, is not limited to the above-described embodiment. Various changes and modifications are possible within the spirit and scope of the present invention. For example, the positions of the electrical connector engaging protrusions 4*b* on the elastic engaging members 4 are not limited to those of the above embodiment. Alternatively, the protrusions 4*d* may be provided at the front ends of the distal or free ends of the elastic tongue members 4*a*. In addition, the positions of the interfering members 4*c* are not limited to those directly opposing the protrusions 4*d*. It goes without saying that the positions of the interfering members 4*c* may also be provided at the front ends of the elastic tongue members 4*a*. Alternatively, the interfering members 4*c* may be provided at any position between the front and rear ends of the elastic tongue members 4*a*. In this case, the interfering member receiving recesses 38 are to be formed at positions corresponding to the positions of the interfering members 4*c* in order to function as escapes therefore. In addition, the interfering members 4*c* may be of any desired shape, such as that of a plate or a block, as long as the interfering members 4*c* seal the gap 36.

What is claimed is:

1. A wire cover for an electrical connector that defines the direction in which a plurality of wires is led out of the electrical connector, comprising:

a main body having side walls, at least one of the side walls having an interference member receiving recess;

an elastic engaging member extending from a lower edge of at least one of the side walls, the elastic engaging member having an elastic tongue member bent upwards from the lower edge such that a gap is formed between the elastic tongue member and the side wall;

an interfering member extending from the elastic engaging member and into the interference member receiving recess when the elastic engaging member is flexed, the interfering member substantially covering the gap; and an electrical connector engaging protrusion extending from the elastic engaging member that engages the electrical connector.

2. The wire cover of claim 1, further comprising an engaging protrusion extending from a lower edge of at least one of the side walls, the engaging protrusion being inelastic.

3. The wire cover of claim 2, wherein the engaging protrusion and the elastic engaging member are formed at corners of the main body.

4. The wire cover of claim 2, further including a wire guiding section for changing the directions of the wires which are housed within the main body.

5. The wire cover of claim 4, wherein the engaging protrusion is provided closer to the wire guiding section than the elastic engaging member.

6. The wire cover of claim 1, wherein the main body further includes support ribs.

7. The wire cover of claim 1, wherein the wire cover is integrally formed from a synthetic resin.

8. The wire cover of claim 1, wherein the wire cover includes wire viewing openings.

9. The wire cover of claim 1, further including a wire guiding section for changing the directions of the wires which are housed within the main body.

10. An electrical connector, comprising:

a connector main body having a wire cover mounting recess surrounded by walls, the walls having openings formed in corners thereof; and a wire cover mounted in the wire cover mounting recess, the wire cover having a main body with an elastic engaging member extending from a lower edge thereof that engages one of the openings and an engaging protrusion extending from the lower edge thereof that engages another one of the openings, the engaging protrusion being inelastic and being a pivot point for the wire cover when engaged in the opening.

11. The electrical connector of claim 10, wherein the elastic engaging member includes an elastic tongue member bent upwards from the lower edge such that a gap is formed between the elastic tongue member and a side wall of the wire cover.

12. The electrical connector of claim 11, wherein the elastic engaging member includes an interfering member extending from the elastic engaging member and into an interference member receiving recess in the side wall when the elastic engaging member is flexed during pivoting of the wire cover, the interfering member substantially covering the gap.

13. The wire cover of claim 10, further including a wire guiding section for changing the directions of wires which are housed within the main body.

14. The wire cover of claim 13, wherein the engaging protrusion is provided closer to the wire guiding section than the elastic engaging member.

15. The wire cover of claim 10, wherein the main body further includes support ribs.

16. The wire cover of claim 10, wherein the wire cover is integrally formed from a synthetic resin.

17. The wire cover of claim 10, wherein the wire cover includes wire viewing openings.

* * * * *